US009994947B2

(12) United States Patent
Walker et al.

(10) Patent No.: US 9,994,947 B2
(45) Date of Patent: Jun. 12, 2018

(54) METHOD FOR PRODUCING DEFECT-FREE THREADS FOR LARGE DIAMETER BETA SOLUTION TREATED AND OVERAGED TITANIUM-ALLOY BOLTS

(71) Applicant: Sikorsky Aircraft Corporation, Stratford, CT (US)

(72) Inventors: Todd David Walker, Keller, TX (US); Gregory William Lundeen, Lake Worth, TX (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 416 days.

(21) Appl. No.: 14/711,291

(22) Filed: May 13, 2015

(65) Prior Publication Data

US 2016/0017470 A1 Jan. 21, 2016

Related U.S. Application Data

(60) Provisional application No. 62/025,306, filed on Jul. 16, 2014.

(51) Int. Cl.

| | |
|---|---|
| ***C22F 1/18*** | (2006.01) |
| ***C22F 1/00*** | (2006.01) |
| ***C22F 1/02*** | (2006.01) |
| ***C22C 14/00*** | (2006.01) |

(52) U.S. Cl.

CPC ..... *C22F 1/183* (2013.01); *C22C 14/00* (2013.01); *C22F 1/002* (2013.01); *C22F 1/02* (2013.01)

(58) Field of Classification Search

CPC .. C22C 14/00; C22F 1/002; C22F 1/02; C22F 1/183; B23G 2210/08; B21H 3/02; B21H 3/04

USPC ..... 470/8–12; 411/416; 408/215–222

See application file for complete search history.

(56) References Cited

U.S. PATENT DOCUMENTS

| | | | | |
|---|---|---|---|---|
| 3,589,696 | A | 6/1971 | Westeren et al. | |
| 5,399,212 | A * | 3/1995 | Chakrabarti | C22C 14/00 148/421 |
| 5,961,267 | A * | 10/1999 | Goss | B21H 3/027 411/386 |
| 7,449,075 | B2 | 11/2008 | Woodfield et al. | |
| 2009/0056841 | A1* | 3/2009 | Riffee, Jr. | C22F 1/183 148/671 |
| 2011/0268602 | A1* | 11/2011 | Wright | C22C 1/02 420/419 |
| 2012/0076612 | A1* | 3/2012 | Bryan | C22F 1/183 411/204 |
| 2012/0148412 | A1* | 6/2012 | Decker | B22C 9/04 416/223 A |
| 2012/0234066 | A1* | 9/2012 | Takahashi | C22C 14/00 72/200 |

FOREIGN PATENT DOCUMENTS

GB 1425213 A 2/1976

OTHER PUBLICATIONS http://www.tppinfo.com/heat_treatment/vacuum_heat_treatment/gas_quenching.html Published on Jan. 6, 2009.*

* cited by examiner

*Primary Examiner* — Jenny R Wu
(74) *Attorney, Agent, or Firm* — Cantor Colburn LLP

(57) ABSTRACT

A method for producing a Ti-6Al-4V article, includes providing a work piece of a Ti-6Al-4V alloy having a beta-transus temperature; subjecting the work piece to a beta solution heat treatment process in a furnace with a vacuum at a temperature above the beta transus; quenching the work piece in the furnace using high pressure inert gas following the subjecting of the work piece in the beta solution heat treatment process; and subjecting the work piece to an overage heat treatment process in the furnace with a vacuum to overage the work piece following the quenching of the work piece. The work piece can be a bolt blank that is further manufactured into a titanium bolt with pre-machined wave form threads and wave form rolling process utilized to manufacture threads into the bolt blank.

12 Claims, 2 Drawing Sheets

METHOD FOR PRODUCING DEFECT-FREE THREADS FOR LARGE DIAMETER BETA SOLUTION TREATED AND OVERAGED TITANIUM-ALLOY BOLTS

CROSS-REFERENCE TO RELATED APPLICATIONS

This application claims the benefit of U.S. provisional patent application Ser. No. 62/025,306 filed Jul. 16, 2014, the entire contents of which are incorporated herein by reference.

STATEMENT REGARDING FEDERALLY SPONSORED RESEARCH OR DEVELOPMENT

This invention was made with Government support with the United States Navy under Contract No. N00019-06-C-0081. The Government therefore has certain rights in this invention.

FIELD OF INVENTION

The subject matter disclosed herein relates generally to the field of titanium alloys, and to a beta solution and overaging heat treatment in a vacuum for processing large diameter threaded titanium alloy bolts.

DESCRIPTION OF RELATED ART

Beta-processed alpha-beta titanium alloys are used to manufacture aerospace hardware such as components of gas turbine engines. These alloys have excellent mechanical properties relative to their weight, at both room temperature and moderate elevated temperatures as high as about 1200 degree Fahrenheit (F.). The alloys are used to make parts such as, for example, fan and compressor disks, blades, shafts, airframe structure, fittings, and engine mounts.

An alpha-beta titanium alloy is an alloy having more titanium than any other element, and which forms predominantly two phases, alpha phase and beta phase, upon heat treatment. In titanium alloys, alpha ($\alpha$) phase is a hexagonal close packed ("HCP") phase thermodynamically stable at lower temperatures, beta ($\beta$) phase is a body centered cubic ("BCC") phase thermodynamically stable at higher temperatures above a temperature termed the "beta transus" temperature that is a characteristic of the alloy composition, and a mixture of alpha and beta phases is thermodynamically stable at intermediate temperatures. Alpha-Beta alloys, which include Ti-6Al-4V, are the most widely used titanium alloy. Ti-6Al-4V alloy consists essentially of, by weight, 6 percent aluminum and 4 percent vanadium, and other alpha phase forming and beta phase stabilizing alloying elements, with the balance being titanium.

Typical standard processing of a Ti-6Al-4V bolt blank creates issues during processing with standard Beta Solution Treatment and Overage ("BSTOA") processing. For example, excessive alpha case buildup exceeding 0.010 inches on all surfaces of bolt blanks are formed from diffusion of oxygen & nitrogen during beta solution treat temperatures above the beta transus, generally greater than 1875 degree Fahrenheit. Generally, forgings are designed with excess surface thickness to insure removal by machining of any alpha case layer. However, bolt blanks require upset forging of the shank to head transition area in order to strengthen the area with directional grain flow. Machining for alpha case removal is to a depth that removes the grain flow, thereby reducing the bolt head to shank strengthening. Other issues using the standard BSTOA processing methods include the potential for reduced ductility with water quenching thinner sections (<2.0 inches) and related unacceptable crest and flank laps on threads from the standard single rolling process.

BRIEF SUMMARY

According to one aspect of the invention, a method for producing a Ti-6Al-4V article, includes providing a work piece of a Ti-6Al-4V alloy having a beta-transus temperature; subjecting the work piece to a beta solution heat treatment process in a furnace with a vacuum at a temperature above the beta transus; quenching the work piece in the furnace using high pressure inert gas following the subjecting of the work piece in the beta solution heat treatment process; and subjecting the work piece to an overage heat treatment process in the furnace with a vacuum to overage the work piece following the quenching of the work piece.

In addition to one or more of the features described above, or as an alternative, further embodiments could include surface cleaning the work piece using one of abrasive media blasting, acid etching, or solvent emulsion cleaning prior to the beta solution heat treatment process.

In addition to one or more of the features described above, or as an alternative, further embodiments could include beta solution heat treating the work piece at a temperature in a range of about 50 degrees Fahrenheit to about 100 degrees Fahrenheit above the beta transus generally greater than 1875 degrees Fahrenheit for a time period between 30 and 60 minutes.

In addition to one or more of the features described above, or as an alternative, further embodiments could include quenching the work piece in one of a pressurized helium or argon inert gas that is configured to maintain a cooling rate of at least 280 degrees Fahrenheit per minute.

In addition to one or more of the features described above, or as an alternative, further embodiments could include quenching the work piece using the high pressure inert gas at a pressure in a range of about 200 kilopascals to about 400 kilopascals that is configured to lower a temperature of the work piece to below 600 degrees Fahrenheit.

In addition to one or more of the features described above, or as an alternative, further embodiments could include cooling the work piece in a high pressure inert gas following the subjecting of the overage heat treatment process.

In addition to one or more of the features described above, or as an alternative, further embodiments could include cooling the work piece in one of a high pressure helium or argon inert gas that is configured to lower a temperature of the work piece to below 175 degrees Fahrenheit.

In addition to one or more of the features described above, or as an alternative, further embodiments could include pressurizing the furnace at a pressure in a range of about 200 kilopascals to about 400 kilopascals during the cooling of the work piece.

In addition to one or more of the features described above, or as an alternative, further embodiments could include subjecting the work piece to a temperature in a range of about 1100 degrees Fahrenheit to about 1400 degrees Fahrenheit in a vacuum for about 2.5 hours to about 3 hours.

In addition to one or more of the features described above, or as an alternative, further embodiments could include processing the work piece during each of the beta solution heat treatment process, overage heat treatment process, and high pressure inert gas quenching without removal from the furnace.

In addition to one or more of the features described above, or as an alternative, further embodiments could include manufacturing threads into the work piece using a pre-machined wave formed thread pattern prior to thread rolling.

In addition to one or more of the features described above, or as an alternative, further embodiments could include creating the threads using one of a conventional thread rolling process or a wave form thread rolling process.

Technical function of the embodiments described above include providing threaded bolts with defect free threads in Ti-6Al-4V bolts, greater than 1 inch in diameter, with fracture toughness and bolt mechanical properties markedly higher than conventional standard fatigue rated Ti-6Al-4V solution treated and overaged bolts.

Other aspects, features, and techniques of the invention will become more apparent from the following description taken in conjunction with the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

The present invention is more particularly described in the following description and examples are intended to be illustrative only since numerous modification and variations therein will be apparent to those skilled in the art. As used in the specification and in the claims, the singular form "a", "an", and "the" may include plural referents unless the context clearly dictates otherwise. Also, all ranges disclosed herein are inclusive of the endpoints and are independently combinable.

Embodiments of a method for beta solution and treatment overaged (BSTOA) processing of large diameter Ti-6Al-4V alloys includes vacuum processing and high pressure inert gas quenching. Particularly, the method relates to BSTOA processing of the Ti-6Al-4V alloy, for example, upset forged Ti-6Al-4V bolt blanks in order to minimize surface oxidation by beta solution heat treatment in a vacuum furnace and quenching using high pressure inert gas. Overaging is subsequently performed after quenching in a vacuum. The vacuum processed BSTOA process and high pressure inert gas quenching enables a reduction of alpha case formation of below 0.006 inches, reducing the depth of surface machining, resulting in material mechanical properties that meet fracture toughness, tensile strength, and ductility requirements.

Figure 1:
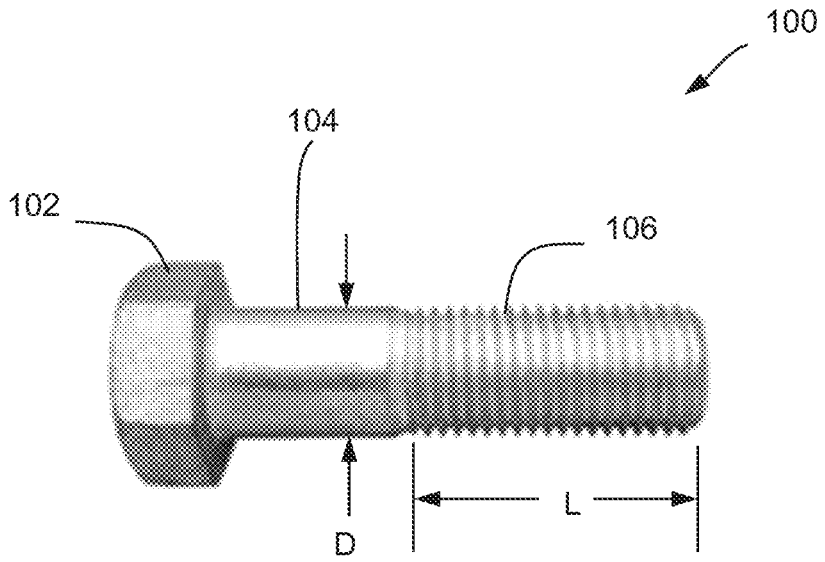
FIG. 1 illustrates a perspective view of an article produced by an exemplary BSTOA process in accordance with an embodiment of the invention.

FIG. 1 illustrates an exemplary article 100 such as, for example, a Ti-6Al-4V bolt (hereinafter "Ti 6-4") for use in an aircraft that is made using an exemplary process depicted in FIG. 2 in accordance with an embodiment of the invention. The Ti 6-4 standard abbreviated form means that the alloy has a nominal composition of 6 percent aluminum, 4 percent vanadium, and other alpha phase forming and beta phase stabilizing alloying elements, with the balance being titanium. Bolt 100 includes a bolt head 102 connected to a shank 104. Shank 104 includes a threaded portion 106 having a thread length L. In an embodiment, article 100 is a large diameter bolt with a shank diameter D of greater than 1.25 inches. While the invention is described with reference to a bolt 100, other types of Ti 6-4 articles including, for example, compressor disks, blades, rings, airframe structure, shafts, fittings, mounts, or the like can also be produced using the process depicted in FIG. 2.

Figure 2:
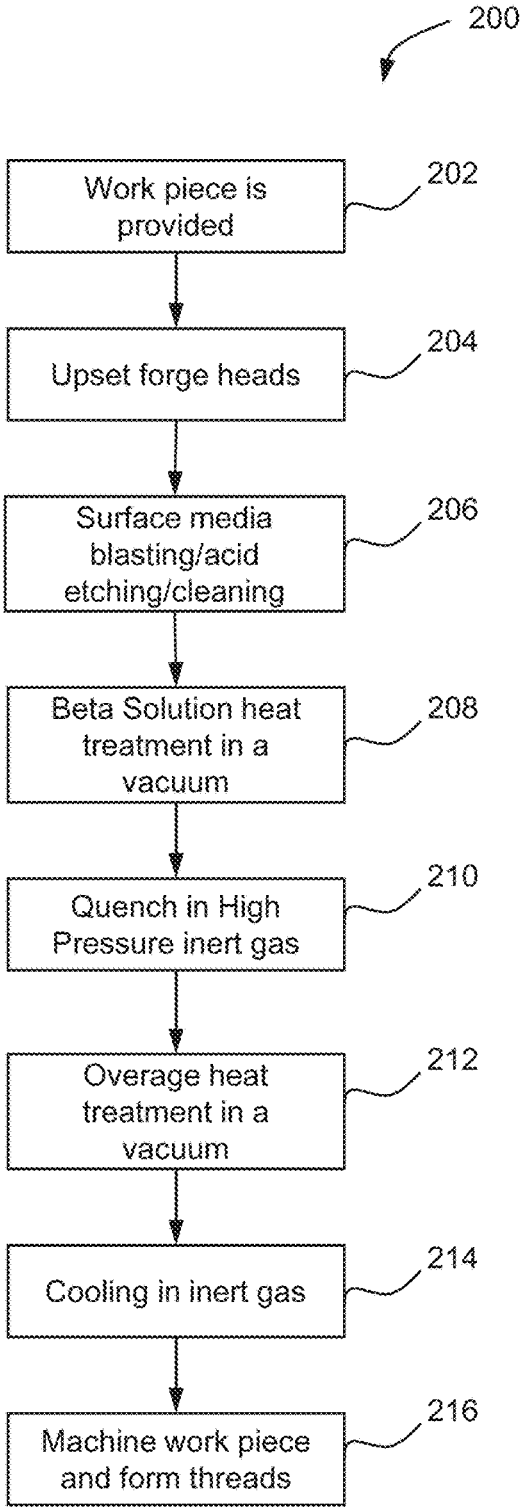
FIG. 2 illustrates a flow diagram for an exemplary process for BSTOA processing of a Ti-6Al-4V alloy in accordance with an embodiment of the invention.

FIG. 2 depicts a flow chart of an exemplary process 200 for producing a finished Ti 6-4 article, for example, Ti 6-4 bolt 100, from a Ti 6-4 work piece in accordance with an embodiment of the invention. According to the exemplary process, a work piece of a Ti 6-4 alloy is provided in step 202. In 204, the work piece may be upset forged from a bar or rod in order to form a bolt head 102 (FIG. 1) with a grain flow in a region connecting the bolt head 102 (FIG. 1) to the shank 104 (FIG. 1). Thereafter, in 206, any upset forging surface oxidation, forging die lubricant compounds, or organic contaminants are removed from the surface of the work piece by a suitable technique such as abrasive media blasting, acid etching, solvent emulsion cleaning, or the like.

In 208, following surface cleaning, the work piece is beta solution heat treated in a furnace with a vacuum. In an example, the upset forged work piece is beta solution heat treated in the furnace having a vacuum at a temperature in a range of about 50 degrees to about 100 degrees Fahrenheit ("deg. F.") above the beta transus generally greater than 1875 deg. F. The work piece is beta solution heat treated for sufficient time for complete beta phase formation. In an embodiment, the work piece is beta solution heat treated between 30 to 60 minutes in a vacuum at a pressure of about $1\times10^{-4}$ Torr or less.

At the completion of beta solution heat treatment, the work piece is quenched in the furnace with a high pressure inert gas in 210. The beta solution heat treatment and high pressure inert gas quenching establish and stabilize the relative amounts of the beta phase and the alpha phase for the work piece. In an example, the furnace vacuum environment is exchanged with pressurized Helium for quenching at a pressure of about 2 Bar (about 200 kilopascals) to about 4 Bar (about 400 kilopascals). In another embodiment, a high pressure Argon inert gas can also be used in lieu of Helium during quenching. In an example, the furnace vacuum environment is exchanged with pressurized Helium inert gas quenching to maintain a minimum cooling rate of about 280 deg. F./minute or faster to lower the temperature of the work piece to about 600 deg. F.

Following quenching (and when the work piece temperature is below 600 deg. F.), the work piece is overage heat treated in a vacuum in 212 in order to agglomerate the strengthening phases, thereby increasing the fracture toughness. For example, the furnace is evacuated in order to remove the Helium inert gas and the work piece is vacuum overage heat treated at a temperature in a range of about 1100 deg. F. to about 1400 deg. F. In an embodiment, the work piece is overage heat treated between 2.5 hours and 3 hours in a vacuum at a pressure of about $1\times10^{-4}$ Torr or less.

At the completion of overage heat treatment in a vacuum, in 214, the work piece is cooled in an inert gas to cool the work piece to below 175 deg. F. In an example, the furnace vacuum is exchanged with pressurized Helium at a pressure in a range of about 2 bar (200 kilopascal) to about 4 bar (400 kilopascal) in order to cool the work piece to below 175 deg. F. In another embodiment, an Argon high pressure inert gas can also be used in lieu of Helium during cooling. It is to be appreciated that the work piece is not removed from the furnace as process steps 208, 210, 212, and 214 are performed and, therefore, the work piece is not exposed to an external air environment that can cause rapid oxidation (or alpha case formation) during the BSTOA process.

After cooling, the work piece is machined to form a Ti 6-4 article in 216. In the example of a threaded bolt 100 of FIG. 1, the bolt blank can be processed in order to establish threads into the bolt blank according to one of several thread manufacturing methods such as, for example, conventional thread rolling and/or pre-machined wave form threads prior to wave form thread rolling. Preferably, the pre-machined wave form threads and wave form rolling process is utilized to manufacture threads into the bolt blank. Processing the bolt blank according to exemplary method 200 reduces the amount of material flow during the high strain rate thread rolling process thereby minimizing thread laps that are rejected during inspection. The process end product results in a bolt greater than 1.25 inches in diameter that meets industry specification Ti-6Al-4V bolt tension and fatigue mechanical properties as well as bolt material tension and fracture toughness specification requirements.

The technical benefits of exemplary embodiments of a BSTOA process for producing an exemplary article include a reduction in alpha case formation to below 0.006 inches as compared to conventional BSTOA processing. Additionally, the processed article includes compatible material mechanical properties including fracture toughness, tensile strength, and ductility as compared to conventional BSTOA processing. Additional benefits include threaded bolts with defect free threads in Ti-6Al-4V bolts greater than 1.25 inches in diameter with fracture toughness and bolt mechanical properties higher than conventional standard fatigue rated Ti-6Al-4V solution treated and overaged bolts.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangements not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for producing an alpha-beta titanium alloy article, comprising:

providing a work piece of an alpha-beta titanium alloy having a beta transus;

subjecting the work piece to a beta solution heat treatment process in a furnace with a vacuum at a temperature above the beta transus;

quenching the work piece in the furnace using pressurized inert gas following the subjecting of the work piece in the beta solution heat treatment process;

subjecting the work piece to an overage heat treatment process in the furnace with a vacuum to overage the work piece following the quenching of the work piece;

cooling the work piece in a pressurized inert gas following the subjecting of the overage heat treatment process;

wherein the work piece is processed during each of the beta solution heat treatment process, pressurized inert gas quenching, overage heat treatment process, and pressurized inert gas cooling without removal from the furnace; and manufacturing threads into the work piece using a pre-machined wave formed thread pattern prior to thread rolling.

2. The method of claim 1, further comprising surface cleaning the work piece using one of abrasive media blasting, acid etching, or solvent emulsion cleaning prior to the beta solution heat treatment process.

3. The method of claim 1 or 2, further comprising beta solution heat treating the work piece at a temperature in a range of about 50 degrees Fahrenheit to about 100 degrees Fahrenheit above the beta transus generally greater than 1875 degrees Fahrenheit for a time period between 30 and 60 minutes.

4. The method of claim 1, further comprising quenching the work piece in one of a pressurized helium or argon inert gas that is configured to maintain a cooling rate of at least 280 degrees Fahrenheit per minute.

5. The method of claim 1 or 4, further comprising quenching the work piece using the pressurized inert gas at a pressure in a range of about 200 kilopascals to about 400 kilopascals that is configured to lower a temperature of the work piece to below 600 degrees Fahrenheit.

6. The method of claim 1, wherein the cooling includes cooling the work piece in one of a pressurized helium or argon inert gas that is configured to lower a temperature of the work piece to below 175 degrees Fahrenheit.

7. The method of claim 1 or 6, further comprising pressurizing the furnace at a pressure in a range of about 200 kilopascals to about 400 kilopascals during the cooling of the work piece.

8. The method of claim 1, wherein subjecting the work piece to an overage heat treatment process includes subjecting the work piece to a temperature in a range of about 1100 degrees Fahrenheit to about 1400 degrees Fahrenheit in a vacuum for about 2.5 hours to about 3 hours.

9. The method of claim 1, wherein the manufacturing of the threads further comprises creating the threads using one of a conventional thread rolling process or a wave form thread rolling process.

10. The method of claim 1, 2, 4, 6, or 8, where the alpha-beta titanium alloy is a Ti-6Al-4V alloy.

11. The method of claim 1, wherein the article is a bolt.

12. The method of claim 1, wherein the work piece is upset forged from a bar or rod to form a bolt head prior to subjecting the work piece to the beta solution heat treatment process.

* * * * *